US006155904A

United States Patent [19]

Spector

[11] Patent Number: 6,155,904

[45] Date of Patent: Dec. 5, 2000

[54] WRESTLING DOLL

[76] Inventor: Donald Spector, 380 Mountain Rd., Union City, N.J. 07080

[21] Appl. No.: 09/241,112

[22] Filed: Feb. 1, 1999

[51] Int. Cl.[7] ..... A63H 3/36; A63H 13/06; A63H 11/06; A63H 3/46

[52] U.S. Cl. ..... 446/320; 446/334; 446/311; 446/370; 446/378

[58] Field of Search ..... 446/320, 334, 446/335, 336, 308, 300, 310, 311, 370, 376, 379, 380, 390, 378; 482/83, 87, 90

[56] References Cited

U.S. PATENT DOCUMENTS

| | | | |
|---|---|---|---|
| 202,990 | 4/1878 | Chinnock | 446/311 |
| 2,085,161 | 6/1937 | Kraus | 482/90 |
| 2,152,311 | 3/1939 | Jacobson | 446/378 |
| 2,224,456 | 12/1940 | Janas | 446/336 X |
| 2,564,813 | 8/1951 | Moyers, Sr. | 446/320 |
| 3,477,171 | 11/1969 | Bonanno | 446/330 |
| 3,501,861 | 3/1970 | Goldfarb et al. | 446/311 X |
| 4,006,555 | 2/1977 | England et al. | 446/378 X |
| 4,233,775 | 11/1980 | Neufeld | 446/370 |
| 4,952,189 | 8/1990 | Barlow | 446/378 X |
| 4,964,836 | 10/1990 | Kamei | 446/370 |
| 5,087,219 | 2/1992 | Price | 446/320 |
| 5,310,380 | 5/1994 | Levy et al. | 446/320 |
| 5,964,634 | 10/1999 | Chang | 446/901 X |

*Primary Examiner*—D. Neal Muir

[57] ABSTRACT

A wrestling doll which functions as an exerciser for a boy playing with the doll and as a surrogate for a wrestling opponent. The doll is composed of a head joined by its neck to a torso from whose shoulder region extend a pair of articulated arm appendages and from whose groin region extends a pair of articulated leg appendages. The wrestling doll is stuffed with compressible material so that it may be comfortably grappled with by the boy player. The head of the doll is spring-biased to resist displacement as are each of the arm and leg appendages. Hence when a boy player free-style wrestles with the doll by manipulating the head as well as the leg and arm appendages, the player exerts various sets of muscles to do so, thereby promoting his general state of fitness.

8 Claims, 1 Drawing Sheet

WRESTLING DOLL

BACKGROUND OF THE INVENTION

1. Field of Invention

This invention relates generally to wrestling dolls for use by boys under the age of nine, and more particularly to a doll of this type which acts as a surrogate for a wrestling opponent and which when grappled with by a boy player gives him a workout enlisting various sets of muscles to promote his general state of fitness.

2. Status of Prior Art

An exerciser is a device requiring muscular strength to operate, the set of muscles involved depending on its nature. Thus a spring-type arm exerciser provided with handles makes it possible for the user to repeatedly stretch the spring and thereby exercise his arm muscles. But in order to promote an individual's general state of fitness, it is necessary that the individual exercise various sets of muscles distributed throughout his body.

In many respects, the exercise which best promotes an individual's general of fitness is free-style wrestling in which two unarmed opponents grapple with each other in order to secure a fall in which the wrestler pins the shoulders of his opponent to the floor. Free style wrestling body engages the entire body of each wrestler and enlists virtually all of the muscles.

Some historians believe that prehistoric man participated in wrestling contests. But all historians recognize that in ancient Greece wrestlers ranked second only to discus throwers as Olympic heroes.

In the United States, professional wrestling as well as college wrestling is in a free style which permits crunching, tackling, tripping, leg holds and other forms of physical contact. But in Continental Europe, the wrestling rules are much stricter, for tripping is not permitted, nor are holds below the waist.

While boys in a 3 to 8 year age range, when free of supervision, will often wrestle with each other, this is an activity that parents do not encourage, for a stronger boy, in vigorously wrestling with a weaker one, may without meaning to do so injure his opponent. However, a popular surrogate for a wrestling opponent is a wrestling doll which typically is about three feet in height and has the body of a boy. This doll is stuffed with compressible material, such as cotton padding or flexible plastic foam so that a boy player wrestling with the doll can safely grapple with it and subject it to various forms of wrestling activity, such as arm or leg holds.

A young boy playing with a wrestling doll can indulge in any type of free-style activity, such as crunching the head against the torso of the doll, and twisting or bending the arm and leg appendages. Because professional wrestling is often seen on television a boy player may seek to imitate a professional performance. Thus to the floor and score a victory over his surrogate opponent. Some boys develop a relationship with their wrestling doll, treating the doll as a home companion.

Yet a standard wrestling doll falls short of being an effective exercise device that promotes a boy player's general state of fitness. The reason for this limitation is that it takes relatively little effort and strength on the part of the boy player to wrestle with the doll, for the doll offers almost no resistance to this activity.

Thus a boy player can spend an extended period grappling with a wrestling doll without getting a workout, for little muscular strength is required to carry out this activity.

Without some degree of physical exertion, there is no exercise. Because a boy player grappling with a conventional wrestling doll can manipulate the doll without straining his muscles to do so, the player does not gain the benefit of exercise, hence this play activity does not promote fitness.

SUMMARY OF INVENTION

In view of the foregoing, the main object of this invention is to provide a wrestling doll which acts as a surrogate for an opponent, which when doll grappled with by a boy player in an age range of about 3 to 8 years, gives the player a good workout.

A significant advantage of a wrestling doll in accordance with the invention is that it lends itself to free style wrestling, for no limit is imposed on the boy player in regard to how he manipulates the doll to simulate wrestling with a real opponent.

More particularly, an object of this invention is to provide a wrestling doll whose head and whose leg and arm appendages are each spring-biased and therefore offer physical resistance to their manipulation. Whereby the wrestling doll is effectively muscled and is capable of competing with the muscles of the boy player.

Also an object of the invention is to provide a wrestling doll which is soft and compressible so that a boy player can comfortably grapple with the doll.

Briefly stated, these objects are attained by a wrestling doll, which functions as an exerciser for a boy playing with the doll and as a surrogate for a wrestling opponent. The doll is composed of a head joined by its neck to a body from whose shoulders extend a pair of articulated arm appendages and from whose groin region extends a pair of articulated leg appendages. The wrestling doll is stuffed with compressible material so that it may be comfortably grappled with by the boy player. The head of the doll is spring-biased to resist displacement as are each of the arm and leg appendages. Hence when a boy player free-style wrestling with the doll by manipulating the head as well as the leg and arm appendages, the player exerts various sets of muscles to do so, thereby promoting his general state of fitness.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
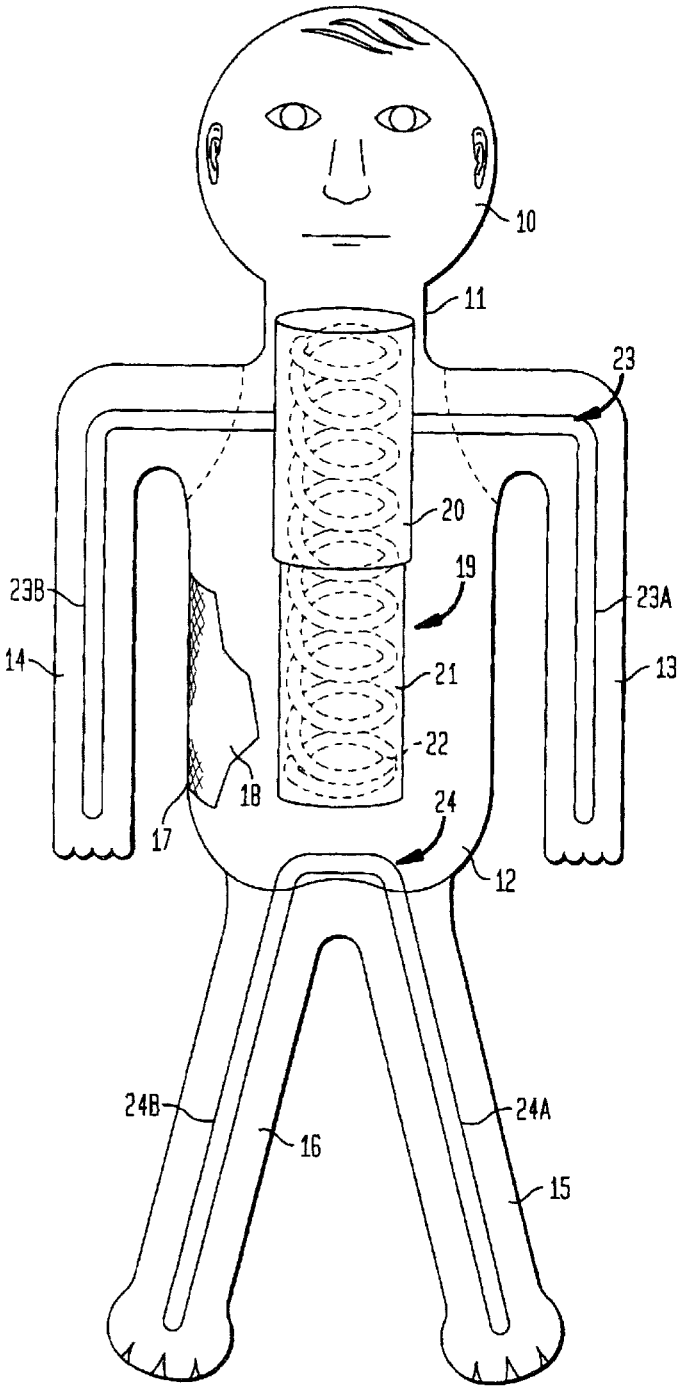
FIG. 1 schematically illustrates a wrestling doll in accordance with the invention.

A wrestling doll in accordance with a preferred embodiment of the invention is formed, as shown schematically in FIG. 1, by a head 10 joined by its neck 11 to a torso 12. Extending from the shoulder region at the upper end of the torso is a pair of articulated arm appendages 13 and 14. Extending from the groin region at the lower end of the torso is a pair of articulated leg appendages 15 and 16.

The appearance of the doll and its height are such as to create a surrogate opponent for the boy player for which the doll is intended. Thus if the boy player is about 7 years old and 3 feet tall, the doll should have a similar height, but should be somewhat more stocky than the average 7 year old.

The advantage of a surrogate wrestling opponent that appears to be heavier than the boy player is that when the boy player succeeds in pinning the surrogate opponent to the floor, he then scores a meaningful victory. In other words, the wrestling doll should not be a pushover for the boy player who wrestles with it. It should give the player a run for his money in the sense that with repeated wrestling matches, the surrogate opponent which functions as an exercise device causes the boy player to gain strength and improve his performance.

The wrestling doll is fabricated from an outer fabric or soft plush casing 17 that is stuffed with compressible material, such as flexible urethane foam, cotton batting or similar material to create a surrogate wresting opponent that is life-like and comfortable to clutch and manipulate. It is important that the casing of the doll be strong and durable so that the doll can withstand whatever physical abuse is inflicted on it by the boy player.

Embedded within the doll and extending between the head 10 and the groin region of the torso 13 why a longitudinal axes is a cylindrical primary spring unit 19.

Unit 19 is composed of a tubular upper section 20 and a tubular lower section 21 telescoped thereon, both sections being molded of high-strength, synthetic plastic, such as polypropylene.

Housed within the telescoping tubular sections of the unit is a long helical spring 22 formed of resilient plastic or metal. In the normal uncompressed state of spring 22, the upper and lower telescoping sections 20 and 21 of the unit are expanded to a degree that acts to maintain the normal length of torso 12.

Figure 2:
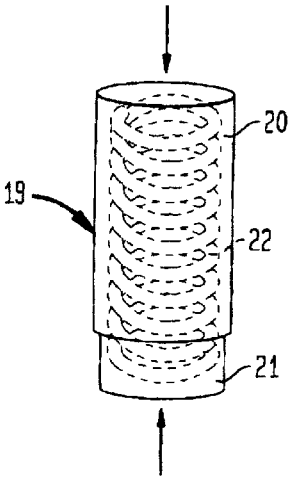
FIG. 2 illustrates the primary spring unit included in the doll in a compressed state.

When a boy player wrestling with the doll, crunches head 10 to cause primary spring unit 19 to compress and shorten in length as shown in FIG. 2, this action brings head 10 closer to the groin region at the lower end of torso 12 and deforms the torso. The sets of muscles in the boy player which are involved in this crunching activity, such as the biceps, are exercised thereby. The compressibility of primary spring unit 19 must take into account the strength of a typical 7 year old boy player, and while the spring unit should not be too difficult for the boy player to compress, neither should it be too easy to compress. In other words, the spring unit must offer sufficient resistance to compression which boy player is capable of overcoming by a fair degree of exertion, for the wrestling doll should be a worthy opponent of the boy player.

Embedded in torso 12 of the doll in the upper shoulder region is a U-shaped secondary spring 23 having a pair of branches 23A and 23B. These branches extend from the yoke of the spring into arm appendages 13 and 14, thereby spring-biasing these appendages so that they normally lie close to torso 13. The branches are buried in the stuffing of these appendages so that the player grappling with the doll makes no contact with the branches.

In grappling with the doll, the boy player can stretch arm appendages 13 and 14 away from torso 12 to a degree that depends on his strength. And in carrying out this activity, the boy player will exercise his chest muscles and biceps and whatever other set of muscles are involved when manipulating the spring biased arm appendages which resist manipulation.

Embedded in the groin region of the torso is another U-shaped spring 24 having a pair of branches 24A and 24B which extend from the yoke of this spring into leg appendages 15 and 16, which spring normally holds these appendages adjacent to each other. A boy player can with his hands or feet grapple with the spring-biased leg appendages and stretch these appendages away from each other to a degree that depends on the child's muscular strength.

Thus the doll acts as a surrogate opponent and because this opponent offers physical resistance to manipulation by the boy player wrestling free style with the doll, the doll is capable of giving the boy player a strenuous workout involving almost every set of the boy's muscles.

Secondary spring 23 and 24 may be made of high strength resilient plastic or metal. A preferred form of secondary spring is one formed of an elongated tightly wound coil, for then one cannot stretch the appendages into which the branches of the spring are inserted, and also bend and twist these appendages.

Figure 3:
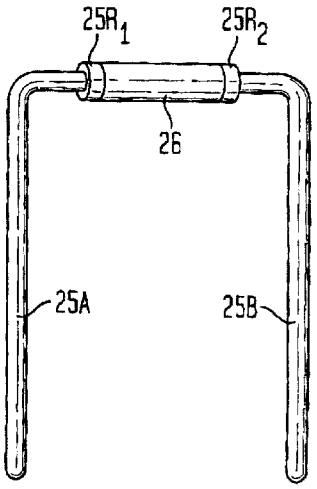
FIG. 3 illustrates a modified form of secondary spring included in the doll.

Alternatively, each secondary spring may be of the type shown in FIG. 3 in which branches 25A and 25B of the spring are coupled by ratchet mechanisms 25$R_1$ and 25$R_2$ to a yoke 26. These branches, since these are of resilient material, may be stretched away from yoke 26 or because of the ratchets, they may be rotated with respect to the yoke, thereby making possible a manipulation of the appendages in similar ways.

Thus a wrestling doll in accordance with the invention, because of the physical resistance it offers to manipulation, functions as an exercise device that exercises virtually all muscles of the boy player who grapples with the doll with his hands and feet in free style wrestling; thereby promoting the general state of the player's fitness.

The yoke of the U-shaped secondary springs are sewn or otherwise anchored to the casing of the doll to maintain their position therein. And in practice, one may embedded sound chips in the torso and in the appendages which are battery-powered, each being activated only by a vigorous movement in the region in which the chip is placed, the chip emitting groans, yells and whatever other sounds a wrestler gives off when subjected to a painful hold.

While there has been shown and described a preferred embodiment of a wrestling doll in accordance with the invention, it will be appreciated that many changes and modifications may be made therein without, however, departing from the essential spirit thereof. Thus to further muscle the wrestling doll, hands at the ends of the arm appendages may be spring loaded and the feet at the ends of the leg appendages may be spring loaded.

I claim:

1. A wrestling doll adapted to give a player who wrestles with the doll a workout, said doll comprising:

a) a head having a neck joined to a torso having an upper shoulder region from which extends a pair of arm appendages, and a lower groin region from which extends a pair of leg appendages, said doll being formed by a flexible outer casing stuffed with compressible material;

b) a compressible primary helical spring unit embedded in the doll and extending longitudinally from the head to the groin region such that when the player crunches the head, the unit is then compressed to deform the torso to bring the head closer to the groin region; and c) a U-shaped secondary spring having a pair of branches which extend into the arm appendages to spring bias these appendages, said U-shaped secondary sprint resiliently biasing the arm appendages towards the torso such that the player can move the arm appendages away from the torso against the bias force of the U-shaped secondary spring.

2. A wrestling doll as set forth in claim 1, in which the compressible primary helical spring unit is housed within a cylindrical container formed by an upper tubular section in which is telescoped a lower tubular section whereby the container may be shortened or lengthened.

3. A wrestling doll as set forth in claim 2, in which the tubular sections are molded of synthetic plastic material.

4. A wrestling doll as set forth in claim 1, in which the compressible material stuffing the casing is a flexible foam plastic.

5. A doll as set forth in claim 4 in which the foam plastic is urethane.

6. A doll as set forth in claim 1, in which the branches of the spring are coupled by a ratchet mechanism to a yoke whereby the branches may each be rotated with respect to the yoke.

7. A doll as set forth in claim 1, further including a U-shaped secondary spring having a pair of branches which extend into the leg appendages to spring bias these appendage, said U-shaped secondary spring resiliently biasing the leg appendages towards the torso such that the player can move the leg appendages away from the torso against the bias force of the U-shaped secondary spring.

8. A doll as set forth in claim 1, in which the arm and leg appendages are each spring biased to offer resistance to manipulation of these appendages.

* * * * *